United States Patent [19]

Maeda et al.

[11] Patent Number: 4,671,082

[45] Date of Patent: Jun. 9, 1987

[54] EVAPORATOR FOR REFRIGERATOR

[75] Inventors: Kensaku Maeda; Satoru Fujiwara; Teiichi Mochizuki, all of Tokyo, Japan

[73] Assignee: Ebara Corporation, Tokyoto, Japan

[21] Appl. No.: 769,325

[22] Filed: Aug. 26, 1985

[30] Foreign Application Priority Data

May 17, 1985 [JP] Japan ..... 60-103883

[51] Int. Cl.[4] ..... F25B 39/02

[52] U.S. Cl. ..... 62/515; 165/157; 312/257 SM

[58] Field of Search ..... 62/515, 503; 165/157, 165/158, 159, 160, 161, 162; 312/257 SM

[56] References Cited

U.S. PATENT DOCUMENTS 2,419,575 4/1947 Leonard ..... 165/158

2,678,547 5/1954 Ashley ..... 62/503

*Primary Examiner*—Ronald C. Capossela

*Attorney, Agent, or Firm*—Oblon, Fisher, Spivak, McClelland & Maier

[57] ABSTRACT

A liquid filled evaporator of the shell and tube type is disclosed which is capable of distributing refrigerant liquid over an overall heat exchanger tube nest to significantly improve the heat exchanging and substantially decreasing the overall dimensions of the evaporator. The evaporator comprises a drum shell formed into substantially a rectangular shape in vertical section and to extend in the lateral direction.

7 Claims, 4 Drawing Figures

EVAPORATOR FOR REFRIGERATOR

BACKGROUND OF THE INVENTION

1. Field of the Invention

This invention relates to an evaporator for a refrigerator, and more particularly to a liquid filled evaporator of the shell and tube type which is adapted to be used for a refrigerator such as a turborefrigerator or the like which includes a refrigerator driven as a heat pump as well.

2. Description of the Prior Art

A typical liquid filled evaporator of the shell and tube type which has been conventionally used is disclosed in Japanese Patent Application Publication No. 11630/1967 and Japanese Patent Application Laid-Open Publication No. 30059/1978. The conventional evaporator taught in the publications includes a cylindrical drum circular in vertical section in which a plurality of heat exchanger tubes are arranged.

The conventional evaporator of such construction will be described with reference to FIGS. 1 and 2 showing a refrigerator in which the evaporator is incorporated.

The refrigerator shown in FIGS. 1 and 2 is constructed in a manner such that gaseous refrigerant is compressed in a turbocompressor 100 and then fed through a discharge pipe 102 to a condenser 104 to be condensed into liquid refrigerant. The so-formed liquid refrigerant is then fed through a passage 106, an orifice 108 and a header box 110 to the lower portion of an evaporator 112 of which the overall shape is cylindrical. The evaporator 112 comprises a drum shell 114 circular in vertical section and an internal construction received in the drum shell 114. The internal construction, as shown in FIG. 2, comprises a distribution orifice plate 116 positioned at the lowermost portion of the interior of the drum shell 114, a distribution plate 118 positioned above the distribution orifice plate 116, a heat exchanger tube nest comprising a plurality of heat exchanger tubes 120 provided above the distribution plate 118, and a partition plate 122 and an eliminator 124 arranged in turn above the heat exchanger tubes 120. Also, the drum shell 114 is provided at the upper portion thereof with a suction pipe 126 connected to the turbocompressor 100. The drum shell 114, as shown in FIG. 1, is closed at both side ends thereof with tube plates 128*a* and 128*b* respectively provided at the lower portions thereof with leg members 130*a* and 130*b*. The heat exchanger tubes 120 each are supported at both ends thereof on the tube plates 128*a* and 128*b* and communicated at the both ends through the tube plates 128*a* and 128*b* with cool water chambers 132*a* and 132*b*, respectively. Also, the eliminator 124 is connected at both ends thereof on the tube plates 128*a* and 128*b* and closed with patches 134*a* and 134*b*, respectively.

In the conventional evaporator, the eliminator 124 is arranged above the heat exchanger tubes 120 at a distance or height H therefrom sufficient to substantially prevent the globules of liquid refrigerant accompanying the gas stream of the refrigerant ascending from the gas-liquid interface of the refrigerant due to the boiling of the refrigerant. Also, it is required to provide, above the eliminator 124, a space 136 sufficient to permit the evaporated refrigerant to be guided therethrough to the suction pipe 126 at an appropriate velocity.

Further, in the conventional evaporator, a plurality of the heat exchanger tubes 120 are arranged in the lower half of the interior of the drum shell 114 and supported at the intermediate portions thereof on a support plate 138.

The arrangement of the heat exchanger tubes 120 in the drum shell 114 is generally carried out in such a manner that the heat exchanger tubes 120 are gradually increased in number from the lowermost tube array to the uppermost tube array to prevent the heat exchanger tubes positioned at both ends of each tube array from contacting the inner surface of the drum shell 114.

However, in the conventional evaporator 112 having the drum shell 114 circular in vertical section, as described above, it is required to install the eliminator 124 at a predetermined height H above the gas-liquid interface of the refrigerant so as to prevent the globules of refrigerant from reaching the eliminator 124 and provide the space 136 above the eliminator which is sufficient to allow evaporated refrigerant to be introduced into the suction pipe 126 at an appropriate velocity.

In the conventional evaporator 112, any restriction due to the internal flow of refrigerant is not imposed on the lateral width dimension of the drum shell 114. Accordingly, when it is required to enlarge the vertical dimension of the the drum shell 114 for the reason as described above, the overall lateral dimension of the drum shell 114 is caused to be excessively extended because the drum shell 114 is generally formed into a circular shape in vertical section. This causes the overall drum shell to be excessively enlarged, resulting in the overall dimensions of the evaporator being substantially enlarged.

Further, in the conventional evaporator, the heat exchanger tubes are gradually decreased in number in the downward direction since the drum shell 114 is circular in vertical section. This results in the outer heat exchanger tubes in all of the heat exchanger tube rows but the lowermost one, or the heat exchanger tubes surrounded by chain lines 140 and 142 in FIG. 2, being not substantially affected by the distribution plate 118, so that refrigerant fails to be subjected to uniform and sufficient agitation at the sections 140 and 142, to thereby deteriorate heat exchanging at the sections.

SUMMARY OF THE INVENTION

The present invention has been made in view of the foregoing disadvantage of the prior art.

Generally speaking, in accordance with the present invention, there is provided a liquid filled evaporator of the shell and tube type, comprising a drum shell formed into a shape rectangular in vertical section and extending in the lateral direction.

In the evaporator according to the present invention of such construction, the drum shell is formed into a shape rectangular in vertical section and laterally extending, so that a distribution plate and a heat exchanger tube nest may be horizontally arranged over the overall section of the drum shell to allow refrigerant liquid to upward uniformly flow across the overall drum shell along the side walls of the drum shell and in a manner to meander through the heat exchanger tube nest to be uniformly boiled. Accordingly, the heat exchanger tubes are subjected to uniform heat exchanging action to carry out satisfactory heat exchanging. Also, this allows the cross sectional area of the drum shell to be substantially decreased to reduce the overall dimensions of the evaporator.

In accordance with the present invention, there is also provided a liquid filled evaporator of the shell and tube type for a refrigerator comprising a drum shell formed into a rectangular shape in vertical section and to extend in the lateral direction, the drum shell comprising an upper shell half member of substantially an inverted L-shape and a lower shell half member of substantially an L-shape which are joined together in a manner opposite to each other.

Accordingly, it is an object of the present invention to provide a liquid filled evaporator of the shell and tube type which is capable of allowing refrigerant liquid to be uniformly distributed over the overall heat exchanger tube nest to carry out the satisfactory agitation, to thereby significantly improve heat exchange.

It is another object of the present invention to provide a liquid filled evaporator of the shell and tube type which is capable of substantially decreasing the overall dimensions of a refrigerator.

It is a further object of the present invention to provide a liquid filled evaporator of the shell and tube type which is capable of readily carrying out assembling and disassembling operations.

It is a still further object of the present invention to provide a liquid filled evaporator of the shell and tube type which is capable of decreasing the number of heat exchange tubes to be arranged in a drum shell to reduce the manufacturing cost.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DETAILED DESCRIPTION OF THE PREFERRED EMBODIMENT

Figure 1:
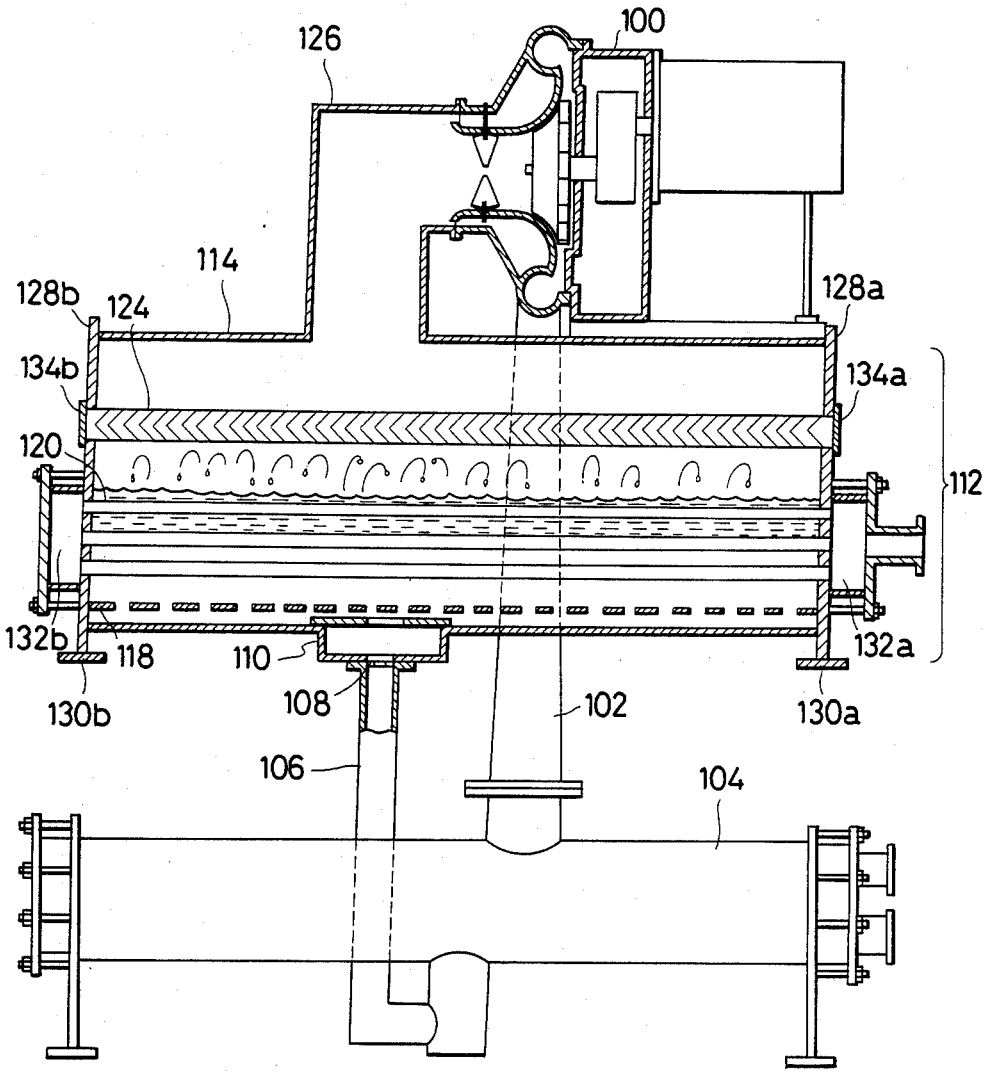
FIG. 1 is a front elevation view partly in section showing a conventional turborefrigerator.
Figure 2:
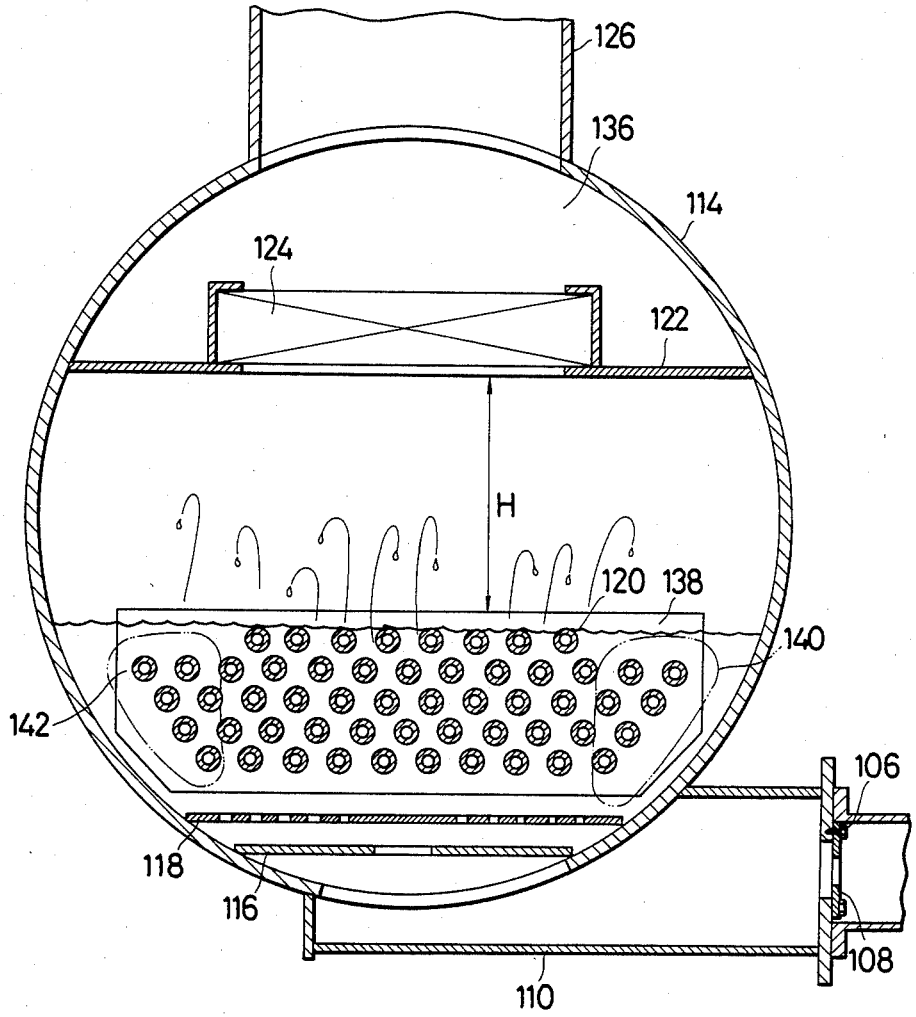
FIG. 2 is a vertical sectional view showing a conventional evaporator used in the refrigerator shown in FIG. 1.

Now, a liquid filled evaporator of the shell and tube type according to the present invention will be described hereinafter with reference to FIGS. 3 and 4.

A liquid filled evaporator of the shell and tube type of the illustrated embodiment includes a drum shell 10 formed into a rectangular shape in vertical section and extending in the lateral direction. In the illustrated embodiment, the drum shell 10 is formed by joining an upper shell half member 12 of substantially an inverted L-shape and a lower shell half member 14 of substantially an L-shape together in a manner to be vertically opposite to each other. The upper shell half member 12 comprises a vertically extending portion 16 of a larger length, a vertically extending portion 18 of a smaller length and a horizontally extending portion 20 which serves to connect the upward extending portions 16 and 18 therethrough to each other and constitutes a top wall of the drum shell 10. In the illustrated embodiment, the upper shell half member is integrally formed. The lower shell half member 14 comprises a vertically extending portion 22 of a larger length of which the upper end is connected to the lower portion of the shorter vertically extending portion 18 of the upper shell half member 12, a vertically extending portion 24 of a smaller length of which the upper portion is connected to the lower end of the longer vertically extending portion 16 of the member 12 and a horizontally extending portion 26 which acts to connect the vertically extending portions 22 and 24 together and constitutes a bottom wall of the drum shell 10.

The evaporator of the illustrated embodiment also includes an internal construction received in the drum shell 10. The internal construction comprises a distribution plate 28 horizontally arranged at the lower portion of the interior of the drum shell 10, a heat exchanger tube nest comprising a plurality of heat exchanger tubes 30 arranged through a tube support plate 32 above the distribution plate 28 and an eliminator 33 provided above the heat exchanger tube nest. The tube support plate 32 is supportedly mounted at both side ends thereof on the inner surfaces of the vertically extending portions 22 and 24 of the lower shell half member 14. The tube support plate 32 also serves to reinforce the drum shell 10. In the illustrated embodiment, the shorter vertically extending portion 24 of the lower shell half member 14 is inward bent at the upper end 34 thereof to provide the lower shell half member 14 with regidity. Also, in the embodiment illustrated, the longer vertically extending portion 22 of the lower shell half member 14 is provided at the portion of the inner surface opposite to the inward bent end 34 of the shorter vertically extending portion with an angle 36, which is adapted to cooperate with the inward bent end 34 to securely support a plurality of bar-like members 38 therebetween, to thereby reinforce the drum shell 10 as well as the lower shell half member 14 to a degree sufficient to allow the drum shell to bear the internal and external pressures applied thereto.

The shorter vertically extending portion 18 of the upper shell half member 12 is inward bent at the lower end 40 thereof to provide the upper shell half member 14 with rigidity. The longer vertically extending portion 16 of the upper shell half member 12 is securely provided at the portion of the inner surface thereof opposite to the inward bent end 40 of the shorter vertically extending portion 18 with an angle 42, which is adapted to cooperate with the inward bent end 40 to rigidly support the eliminator 33 therebetween. Also, in the illustrated embodiment, a plurality of bar-like members 44 are stretched between the angle 42 and the shorter vertically extending portion 18 of the upper shell half member 12 to reinforce the drum shell 10 as well as the upper shell half member 12, to thereby allow the drum shell to more effectively bear the internal and external pressures applied thereto.

The evaporator of the illustrated embodiment also includes a suction pipe 46 connected to the upper wall 20 of the drum shell 10 and a header box 48 mounted to the lower portion of the drum shell 10 and connected through an orifice 50 to a passage 52 so that refrigerant liquid may be introduced from the passage 52 through the orifice 50 into the header box 48. Further, the evaporator includes a passage 54 formed at the lowermost portion of the interior of the drum shell 10 and connected to the header box 48 and a distribution orifice plate 56 arranged in the passage 54.

Figure 3:
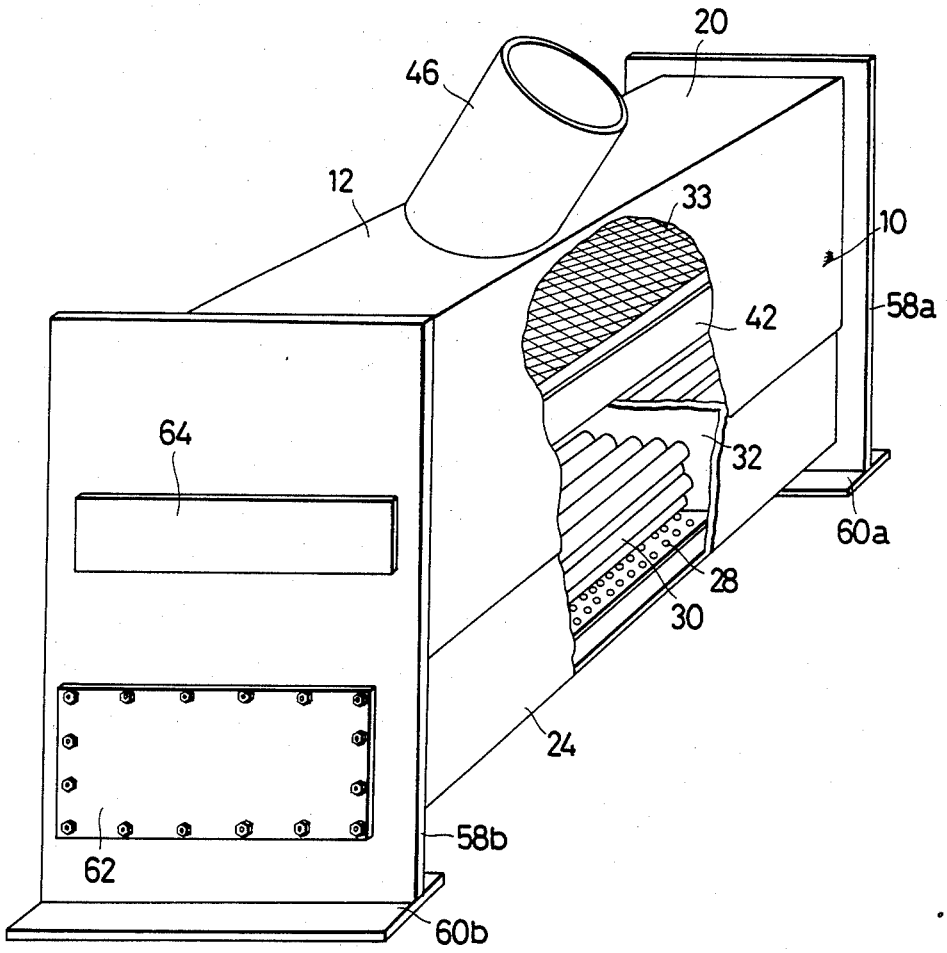
FIG. 3 is a fragmentary broken perspective view showing an embodiment of a liquid filled evaporator of the shell and tube type according to the present invention.
Figure 4:
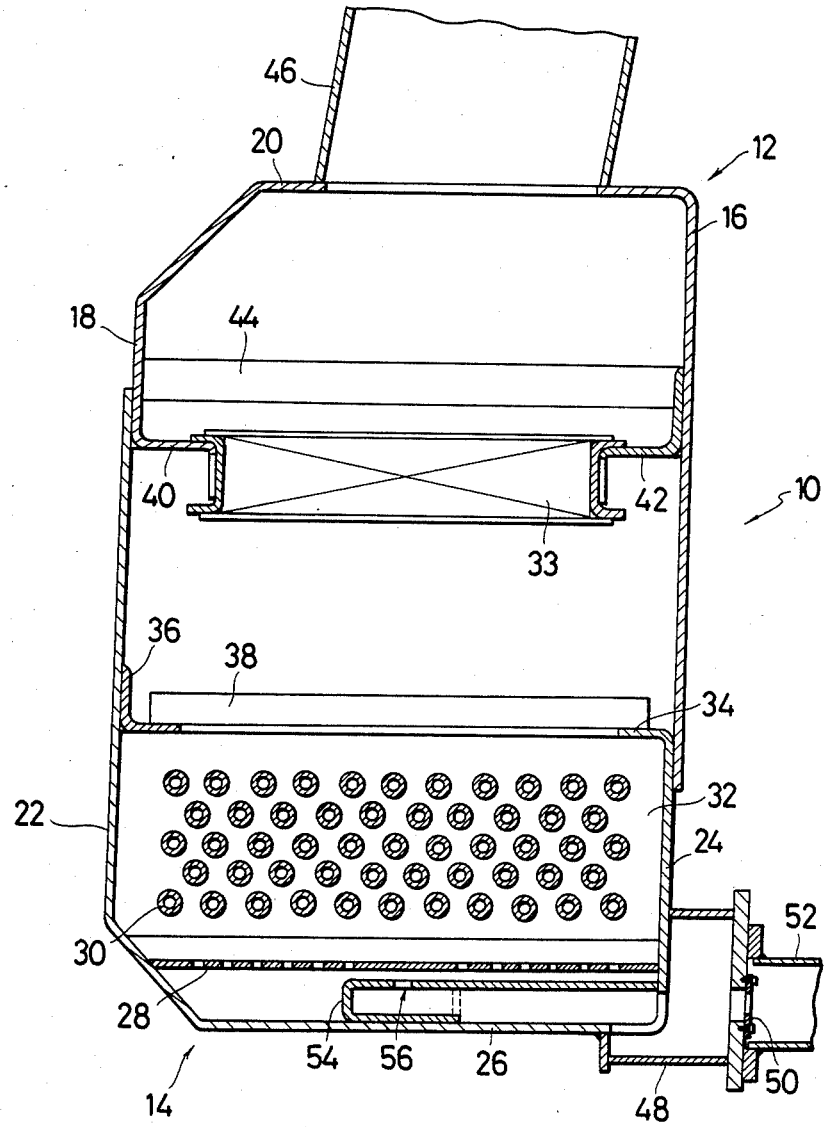
FIG. 4 is a vertical sectional view of the liquid filled evaporator of the shell and tube type shown in FIG. 3.

The drum shell 10, as shown in FIG. 3, is closed at both ends thereof with tube plates 58*a* and 58*b* having legs 60*a* and 60*b* mounted on the lower ends thereof, respectively. The heat exchanger tubes 30 each are supported at both ends thereof on the tube plates 58*a* and 58*b*, and a chilled water chamber 18 is formed at the outside of each of the tube plates 58*a* and 58*b*. Also, the eliminator 33 is supported at both ends thereof on the tube plates 58*a* and 58*b* and closed with patches 64.

The eliminator 33 may be arranged in the drum shell 10 by removing the patch 64 from the tube plates 58*a* and 58*b* and slidingly guiding the eliminator 33 through cutouts of the tube plates along the angle 42 into the drum shell. Alternatively, it may be carried out by mounting the eliminator 33 on the upper shell half member 12 prior to the joining between the upper shell half member 12 and the lower shell half member 14. In this instance, it is not required to use the patch 64 and provide the tube plate 58 with a cutout.

The arrangement of the eliminator in the drum shell is required when the evaporator has large heat exchanging load to cause vigorous boiling in the evaporator. Accordingly, the arrangement of the eliminator may be eliminated when the load is low.

As can be seen from the foregoing, in the evaporator of the present invention, the drum shell is formed into a rectangular shape in vertical section and to extend in the lateral direction, so that the heat exchanger nest and the distribution plate may be arranged in the drum shell so as to be spread over the overall lateral width of the drum shell. This allows refrigerant liquid to uniformly flow through the overall heat exchanger tube nest to be subjected to uniform agitation, to thereby significantly improve the heat exchanging performance as compared with the above-described conventional evaporator of which the overall shape is formed to be circular in vertical section. Also, in the present invention, the drum shell is decreased in lateral width, resulting in a refrigerator being rendered substantially small in dimensions and compact in structure.

Further, the drum shell of a rectangular shape in vertical section in the evaporator of the present invention may be formed by joining the upper shell half member of substantially an inverted L-shape and the lower shell half member of substantially an L-shape together in a manner to be opposite to each other. Such construction of the drum shell allows the arrangement of the distribution plate, heat exchanger tube nest, tube support plates, angles, bar-like members, eliminator and the like in the drum shell to be readily carried out through the shorter vertically extending portions of the shell half members, and the joining between both shell half members is readily accomplished after the arrangement of the internal construction therein.

Thus, it will be noted that the present invention may provide an evaporator of which the performance is highly improved and in which the number of heat exchanger tubes is significantly decreased as compared with the conventional evaporator. Also, the evaporator of the present invention is readily manufactured and rendered sufficiently small in overall dimensions to allow a refrigerator to be compact in structure.

It will thus be seen that the objects set forth above, and those made apparent from the preceding description, are efficiently attained and, since certain changes may be made in the above construction without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A liquid filled evaporator of the shell and tube type for a refrigerator comprising:

a drum shell formed into substantially a rectangular shape in vertical section and extending in the lateral direction;

said drum shell comprising an upper shell half member of substantially an inverted L-shape and a lower shell half member of substantially an L-shape which are joined together in an opposed manner.

2. A liquid filled evaporator of the shell and tube type as defined in claim 1, wherein said upper shell half member has a shorter vertically extending portion and a longer vertically extending portion and said lower shell half member has a longer vertically extending portion and a shorter vertically extending portion;

said upper shell half member and lower shell half member being joined together by connecting said shorter vertically extending portion of said upper shell half member and said longer vertically extending portion of said lower shell half member to each other and connecting said longer vertically extending portion of said upper shell half member and said shorter vertically extending portion of said lower shell half member to each other.

3. A liquid filled evaporator of the shell and tube type as defined in claim 2 wherein said shorter vertically extending portion of said lower shell half member is inward bent at the upper end thereof.

4. A liquid filled evaporator of the shell and tube type as defined in claim 4 wherein said longer vertically extending portion of said lower shell half member is provided at the portion of the inner surface thereof opposite to said inward bent end of said shorter vertically extending portion of said lower shell half member with support means;

said support means cooperating with said inward bent end of said lower shell half member to rigidly support reinforcing means therebetween which reinforces said drum shell.

5. A liquid filled evaporator of the shell and tube type as defined in claim 2 wherein said shorter vertically extending portion of said upper shell half member is inward bent at the lower end thereof.

6. A liquid filled evaporator of the shell and tube type as defined in claim 5 wherein said longer vertically extending portion of said upper shell half member is provided at the portion of the inner surface thereof opposite to said inward bent end of said shorter vertically extending portion of said upper shell half member with support means;

said support means cooperating with said inward bent end of said upper shell half member to support an eliminator therebetween.

7. A liquid filled evaporator as defined in claim 6 wherein said support means cooperates with said shorter vertically extending portion of said upper shell half member to rigidly support additional reinforcing means therebetween which further reinforces said drum shell.

* * * * *